United States Patent [19]

Schwartz

[11] 3,992,077

[45] Nov. 16, 1976

[54] SEPARABLE ELECTRICAL CONNECTION ARRANGEMENT

[75] Inventor: Hermann Schwartz, Pfaffikon, Switzerland

[73] Assignee: Siegfried Peyer, Bach, Switzerland

[22] Filed: June 25, 1975

[21] Appl. No.: 590,295

[30] Foreign Application Priority Data

July 1, 1974 Switzerland ..... 8978/74

[52] U.S. Cl. ..... 339/288 R

[51] Int. Cl.[2] ..... H01R 11/22

[58] Field of Search ..... 339/47 R, 47 C, 49 R, 339/258 R, 258 F, 258 P

[56] References Cited

UNITED STATES PATENTS

| | | | |
|---|---|---|---|
| 1,225,127 | 5/1917 | Heath | 339/47 C |
| 2,629,763 | 2/1953 | Macy | 339/49 R |
| 2,636,071 | 4/1953 | Matthysse | 339/47 C |
| 2,738,477 | 3/1956 | Matthysse | 339/47 C |

*Primary Examiner*—Gerald A. Dost

*Attorney, Agent, or Firm*—Flynn and Frishauf

[57] ABSTRACT

To provide a readily separable electrical in-line connection in which mechanical stress on the terminal itself is relieved, one terminal strip or lug, in a flat strip form, is engaged by another terminal lug having a bent-over tab, so that, in cross section, the other terminal element is U-shaped; one of the terminal elements has a hole punched into it, and the other has a projecting pin, fitting into the hole. The two terminal elements are assembled together by inserting the pin in the hole, with the terminal elements respectively aligned at a slight angle, and they are then rotated so that the U-shaped bent-over tab engages around the other terminal element, to make a secure electrical connection which is also mechanically stable.

7 Claims, 2 Drawing Figures

SEPARABLE ELECTRICAL CONNECTION ARRANGEMENT

Figure 1:
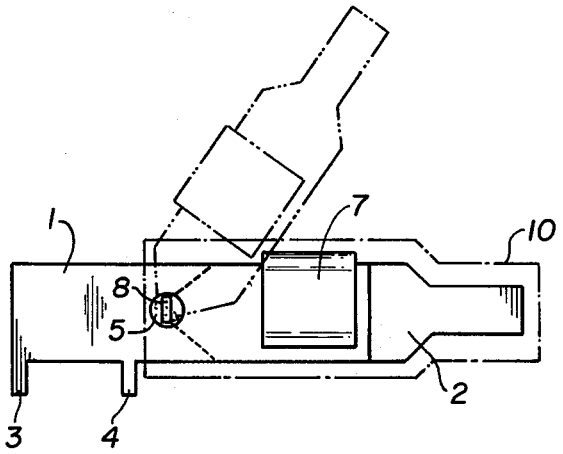

The present invention relates to an electrical connection arrangement and more particularly to make a connection between two separable conductors, for example between a cable connection and a fixed terminal to be associated with other conductor elements.

Various electronic apparatus, electrical apparatus, automotive electrical systems, and the like, require large numbers of inexpensive electrical separable connections, such as plug-and-socket connections, and the like, in which the electrical connections should be reliable and secure, but the voltages used are comparatively low. Flag, or lug-type connectors in which cables or electronic equipment are connected in-line are common; various types of equipment are formed with projecting lugs to make individual connections between the equipment itself and a cable. Cable connectors, in which both terminal elements are connected to cables, are also common.

The best-known and most commonly used system is the AMP-system, in which a flat metal tongue, or lug, of about 1 mm thickness and about 6 mm width is engaged by a matching engagement part adapted to be slipped over the tongue, or lug. The size of the tongue, or lug, may vary, if high currents are to be connected.

The metal tongue, or lug, is preferably connected to the electrical apparatus, which may be a fixed device, or a cable, by riveting, soldering, clamping, or the like. The counter element to the metal tongue, or lug, is a flat sleeve. The flat sleeve, if connected with the cable, is usually pinched, or press-connected to the conductor wire of the cable. Such a sleeve is punched out of sheet metal of approximately 0.5 mm thickness, and then bent over. The bending radius is about 1 mm, and the shape is so arranged that two approximately semi-circular regions are longitudinally bent to form resilient clamping spring elements. The requirements placed on materials are high and it can readily be seen that a material of about 0.5 mm thickness, bent with a bending radius of about 1 mm, loses resiliency and springiness, so that the final bent-over portions are hardly resilient at all after having been deformed. As a result, it is difficult to engage such contacts and, after engagement, to separate such contacts. This difficulty in engagement and separation is particularly annoying if the particular separation point, that is, the terminals are concealed, or are not readily accessible. Electrical connections made in automobile wiring are particularly difficult to make; it is a requirement that the contacting sleeve be moved comparatively accurately in the direction of the metallic connecting tongue or flag, which may be molded into a terminal board on an electrical device or apparatus. The difficulty in separating the connection frequently causes sloppy work, and to sever such a connection — particularly when accessibility is restricted — it is not unusual to find that pull is exerted directly on the wire, or cable which is to be separated from the device, or the other cable element. The contact quality itself can be impaired if a contact sleeve has been moved with respect to a contact tongue or lug several times, due to removal or scraping of metal, and the loss of resiliency of the bent-over portions. If the contact sleeve is not accurately engaged with the contact lug, for example by pushing the contact sleeve at an angle with respect to the lug, minor bending of the contact sleeve will result which, due to the low degree of resiliency of the bentover elements, results in poor or loose connections. It may then be attempted to solve the problem by deforming the contact sleeve with pliers. This is not easy since tolerances between good connection and poor connection are in the order of hundredths of millimeters.

It is customary to apply a plastic sleeve over the contact sleeve itself in order to insulate the connection, and to prevent short circuits as well as possible dangerous contact. This insulation sleeve hides the contact as such from view and, in inaccessible locations, it is necessary to reengage a previously severed connection by "feel". The situtation may arise that the metal tongue or lug is not engaged within the metal sleeve at all but rather behind the metal sleeve and within the plastic sleeve. The quality of the connection will then solely depend on the resiliency of the plastic and the mechanical, as well as electrical reliability of the connection is problematic. Changes in temperature, aging of the plastic, or vibration may lead to complete interruption of contact.

It has previously also been proposed to make plug connectors in which a cylindrical pin is inserted in a relatively resilient cylindrical sleeve or tube. Such connectors avoid many of the disadvantages of the above referred-to connections and are readily connected together. Conversely, however, they can also be readily disconnected and axial loadings on the electrical cables, excessive vibration, or tension forces exerted on the connecting wire itself can sever the electrical connection. Such connectors, therefore, are not suitable for rough environments and particularly not for applications which involve a high degree of vibration, or shock.

Any forces on a push-on connector exerted in direction of servering movement may tend to separate the connector elements. It has, therefore, been customary to connect wires, cables and the like together by means of tension pull-offs, or strain-relievers, clamped, or connected to the wires and cables as such to relieve any mechanical stress which might otherwise be transferred to the electrical connection. This introduces additional material, and handling, and in case of severance of the cable, additional operating steps.

It is an object of the present invention to provide an electrical connection arrangement which can easily be made in mass production, which provides for good electrical contact, has self-stress relieving features and yet permits engagement and disengagement without excessive force, while resulting in reliable electrical contact, the quality of which is retained even after repeated connecting and severing movements.

Subject matter of the present invention

Briefly, one of the connecting elements is an elongated flat strip; the other connecting element is likewise an elongated flat strip which is, additionally, formed with a bent-over flap extending at least in part in parallel to the flat strip. The two elements additionally are formed with an interengaging arrangement, for example a hole in one of them and a bent-over lug in the other, to relieve mechanical stress. The bent-over flap, and the other element, in cross section, are generally U-shaped. To form the connection, the interengaging arrangement, which is so formed that it permits pivoting movement of one element with respect to the other, is first engaged, and the two elements are then pivoted in such a manner that the flat strip element is positioned between the legs of the U, that is, between the flat strip of the other element and the bent-over flap.

The connection arrangement in accordance with the present invention fulfills the requirements placed thereon. The connection elements can easily be made in mass production, as stampings; the U-shaped construction of the element which has the flap provides for a substantial contact surface, thus ensures good electrical contact and, since the length of the flap is not limited by opposing surfaces, sufficient springiness and resiliency of the material is obtainable. The interengaging arrangement, if formed, for example, of a bent-over lug on one element and a hole in the other, can easily be engaged by "feel", and thus does not require visual observation. The connection can be made "blind" without tools, and without requiring substantial connecting, or severing force. Once engaged, that is, once the two elements have been rotated with respect to each other about the pivotal connection so that the U-shaped flap of one element engages over the other, axial separation of the two elements is no longer possible due to the holding effect of the interengaging arrangement.

In its simplest form, the interengaging, pivoting arrangement is simply a hole, or bore, punched or otherwise formed in one strip, and a terminal lug fitting into the hole formed on the other, and bent over from the major plane of the flat strip of the other element. The shape of the elements can readily be matched to those of existing elements, and easily permits use of the connection with slip-over insulation tubing, for example made of plastic.

Figure 2:
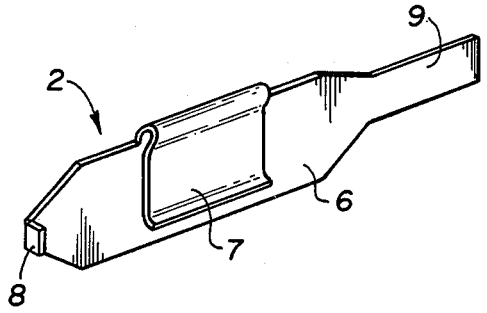

The invention will be described by way of example with reference to the accompanying drawings, wherein:

FIG. 1 is plan view, in schematic form, illustrating the connection in accordance with the present invention; and FIG. 2 is a perspective view of one of the connecting elements, to a somewhat enlarged scale.

The connection arrangement has two connecting elements 1, 2. The connecting element 1 is made as a connecting flag, or connecting lug, or tongue, made, for example, of metal of about 1 mm thickness. As shown in FIG. 1, and by way of example only, the element 1 has two attachment pins 3, 4 formed thereon, for example by punching the entire element 1 with the pins 3, 4 as a single unit, to provide a solder connection for a printed circuit board, or the like. Other connecting arrangements may be used, such rivets, screws, crimp, or pinch connections to cables or the like, as determined by the specific use to which the connector is to be put. A hole 5 of about 2–3 mm is formed just beyond the region where the connecting element 1 is to be attached to a further electrical device, cable, or connection.

The second connecting element 2 is best seen in FIG. 2; this element is made of thinner material, for example bronze sheet metal of about 0.5 mm thickness. The connecting element 2 can be punched out of a flat strip and after, or in connection with the punching, a flap 7 is formed which is bent over in parallel to a flat portion 6 of element 2. The flat portion 6 and the bent-over portion 7, in cross section, are U-shaped; the flap 7 forms a resilient contact spring. If desired, flap 7 can be formed with a slightly cylindrical punch mark, or projection, so that an internally projecting contact button results. Such punch marks may, of course, also be formed on the flat portion 6. To facilitate association of the two contact elements 1, 2 with each other, the lower edge of flap 7 is slightly bent outwardly, as seen in FIG. 2. The forward, or free end of the element 2 is formed with a short, bent-over lug 8, having a width which corresponds to the diameter of the hole 5 in the metal connecting lug or element 1. The other end of the connecting element 2 merges into a strip 9, to which a cable can be connected, the particular strip, as shown in the drawing, being adapted, for example, to a wire wrap connection, to a solder connection, or the like. The region 9 can be formed in accordance with any desired connecting arrangement, for example with a rivet hole, a crimp connection, trough, or in any other suitable shape.

Assembly, use and operation: To effect the connection, elements 1 and 2 are associated with each other so that their major directions extend at an angle, for example a right angle, or, as shown in dashed line in FIG. 1, such that the flap 7 is clear of element 1. Lug 8 is introduced into hole 5, and the element 2 is then pivoted with lug 8 in hole 5 forming the pivot fulcrum from the dotted-line position of FIG. 1 into the solid-line position thereof. This can readily be carried out by hand pressure. The bent-over flap 7, due to its length extending to approximately the width of the zone 6, provides excellent resilient electrical connection, which maintains its electrical quality, even if the connection is broken repeatedly. The relatively long spring, with respect to the deflection thereof, permits wide tolerance in manufactrue, so that minor distortions do not interfere with either the ease of mechanical breaking, or making of the connection, nor with the electrical reliability. If the flap 7 should become loose or distorted, it is an easy matter to put it into proper position by slight pressure with pliers. Any axial tension exerted between elements 1, 2, when associated as shown in FIG. 1, is taken up by the engagement of the lug 8 in the hole 5, thus preventing mechanical stress on the electrical connection and reliably preventing severing of the connection between elements 1 and 2.

A soft, plastic sleeve 10, for example of rectangular cross section, is preferably provided, slipped over the connection after it is made, that is, after the two elements are in the full-line position. Such a sleeve is indicated in chain-dotted lines in FIG. 1. The sleeve prevents pivoting of the two elements with respect to each other, so that, even in the extreme case of a 90° tension — with respect to the major direction of element 1 — being applied on element 2, severing of the connection is not possible.

The connection can easily be made in restricted, inaccessible, or hidden spaces, and is particularly adapted for use in automotive vehicles. It is readily possible to separate the connecting elements, even without visual inspection. It is only required to feel for the plastic sleeve 10, slip it back and then rotate one connecting element with respect to the other, all of which can be done with the fingers of one hand. To make the connection, it is equally simple to feel the element 1, introduce the lug 8 into hole 5 and rotate the elements with respect to each other.

Various changes and modifications may be made within the scope of the inventive concept. For example, the lug 8 may be formed on the element 1, and the element 2 then be formed with a hole 5. Pointing the end of element 2, as shown in the Figures, results in some saving of weight and material and facilitates associating the parts with respect to each other, but the shape of the elements themselves is not critical and may be adapted to various requirements. A punch mark formed on the flap 7, for example, can be used to provide snap-in engagement with a depression, hole, or other punch mark formed on element 1, so that the two elements are securely held together even in the absence of the plastic sleeve 10.

I claim:

1. Separable electrical connection arrangement having two terminal elements, one of said elements (1) being an elongated flat strip, the other of said elements (2) having an elongated flat strip portion (6) and a bent-over cover flap (7) extending at least in part essentially in parallel to the flat strip portion (6);

and interengaging pivot means (5, 8) linking said elements pivotally together to enable swinging of the first element between the flat strip portion (6) and the bent-over flap (7) of the second element (2) upon relative pivoting movement between said elements (1, 2), said interengaging pivot means comprising an opening (5) formed in one of said elements and a bent-over lug (8) formed on the other element, and shaped to fit into said opening (5).

2. Arrangement according to claim 1, wherein the flat strip portion (6) and the bent-over flap (7) of the second element (2) are, in cross section, U-shaped, the bent-over flap (7) forming an elastic clip.

3. Arrangement according to claim 1, wherein the second element (2) is formed at one end with the lug (8), said lug (8) extending at approximately right angles from the flat strip portion (6), the second element (2) being further formed at the other end with electrical connection attachment means (9).

4. Arrangement according to claim 1, further comprising an insulating sleeve (10) slipped over said connection arrangement and, when said elements are connected together, preventing relative pivoting movement, and hence disconnection of said elements.

5. Arrangement according to claim 1, wherein the first one of said elements (1) has the opening formed therein and the second of said elements (2) has the lug (8) formed as a projection extending at approximately right angles from said strip-like portion and of configuration and size to fit into said opening and to provide the pivotal connection with said first element.

6. Arrangement according to claim 1, wherein the opening (5) is located intermediate the length of the respective element.

7. Arrangement according to claim 6, wherein the lug (8) is formed on said second element.

* * * * *